US008021627B2

(12) United States Patent
Molitor

(10) Patent No.: US 8,021,627 B2
(45) Date of Patent: Sep. 20, 2011

(54) PIPETTING DEVICE

(75) Inventor: Peter Molitor, Henstedt-Ulzburg (DE)

(73) Assignee: Eppendorf AG, Hamburg (DE)

( * ) Notice: Subject to any disclaimer, the term of this patent is extended or adjusted under 35 U.S.C. 154(b) by 905 days.

(21) Appl. No.: 11/365,257

(22) Filed: Mar. 1, 2006

(65) Prior Publication Data

US 2006/0222570 A1 Oct. 5, 2006

(30) Foreign Application Priority Data

Mar. 31, 2005 (DE) ..... 10 2005 014 572

(51) Int. Cl.
*B01L 3/02* (2006.01)

(52) U.S. Cl. ..... 422/501; 422/521; 422/922; 436/180; 73/864; 73/864.32

(58) Field of Classification Search ..... 422/100, 422/99, 102, 104, 501, 521, 922; 73/864–864.34, 73/863.32; 436/180
See application file for complete search history.

(56) References Cited

U.S. PATENT DOCUMENTS 2,645,949 A * 7/1953 De Boisblanc ..... 73/64.45

FOREIGN PATENT DOCUMENTS

| | | |
|---|---|---|
| EP | 0 093 355 | 4/1983 |
| EP | 0 215 536 | 1/1986 |
| EP | 0 820 811 A2 | 6/1994 |
| EP | 0 982 073 B1 | 8/1999 |
| WO | 02/092228 A2 | 11/2002 |

* cited by examiner

*Primary Examiner* — Jill Warden
*Assistant Examiner* — Cedric Chan
(74) *Attorney, Agent, or Firm* — Vidas, Arrett & Steinkraus

(57) ABSTRACT

A pipetting device with a displacement chamber, a flexible membrane delimiting the displacement chamber, a driving equipment for deforming the membrane, a coupling equipment between the driving equipment and the membrane for coupling the driving equipment with the membrane, an equipment for detachably holding a pipette tip, a connection channel between the displacement chamber and the equipment for detachably holding the pipette tip, and an aperture equipment, covering the edge region of the membrane with at least one adjustable aperture opening straight through which the central region of the membrane is deformable.

19 Claims, 2 Drawing Sheets

PIPETTING DEVICE

CROSS-REFERENCE TO RELATED APPLICATIONS

Figure 1:
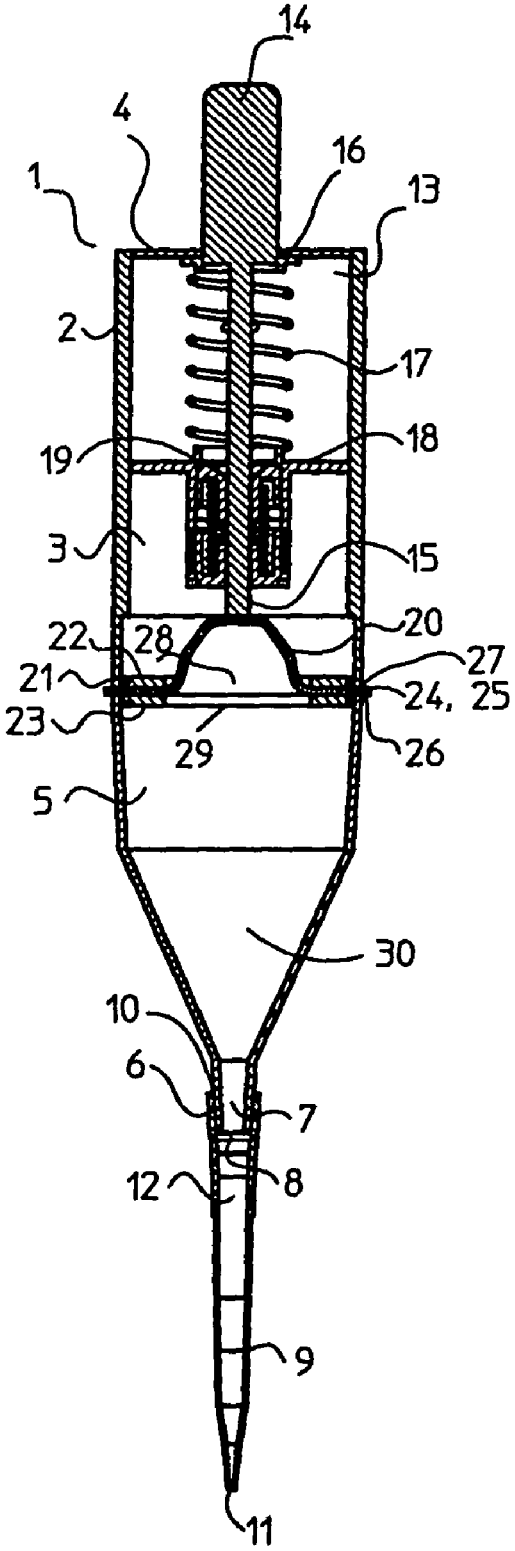

Not applicable.

STATEMENT REGARDING FEDERALLY SPONSORED RESEARCH

Not applicable.

BACKGROUND OF THE INVENTION

Pipetting devices or pipettes, respectively, are used for dosing liquids, together with pipette points. Pipette points are little pipes with an upper opening for joining them with a pipette, a lower opening for the passage of liquid and a passage channel between the upper opening and the lower opening. Pipettes have mostly a neck for putting on the upper opening, or an accommodation for putting in that end of the pipette point which has the upper opening. Further, they have a gas displacement equipment, which is realised in piston pipettes as a cylindrical displacement chamber with a piston movable therein. In manual pipettes, the piston is moved against the action of a pull-back spring by means of an actuation button. In electric pipettes, an electric driving motor is coupled to the piston via a gear, in order to move it to and from in the cylinder. The gas displacement equipment is connected to the upper opening of the pipette point, which is detachably held on the pipette, via a connection channel that runs through the neck or runs out in the accommodation.

By means of the gas displacement equipment, an air column or a column of another gas is moved in order to aspirate liquid into the pipette point and to eject it from the same. When the gas column is pushed away from the pipette point, a certain amount of liquid is aspirated into the passage channel of the pipette point via the lower opening when the pipette point is immersed into a liquid. By moving the gas column towards the pipette point, a certain amount of liquid is delivered from the passage channel through the lower opening. The dosing volume depends on the degree of movement of the gas column. The latter is set by the stroke of the piston in piston pipettes.

Pipette points are mostly replaced by fresh pipette points after dosing has taken place, in order to avoid contamination of subsequently pipetted liquids by remaining liquid. Pipette points for single use are mostly realised from plastic material.

In manual pipettes with adjustable dosing volume, a shiftable limit stop for delimiting the piston stroke is available. The shifting takes place by means of a little turning wheel, which acts on the limit stop via a gear, wherein the dosing volume that is set can be read by means of a metre.

In electronic pipettes it is known, e.g., to use step motors and to ensure the reaching of a dosing volume which is set by applying a corresponding number of control pulses. Furthermore known is counting the rotations and stopping the driving motor when a number of rotations corresponding to the dosing volume has been reached.

The known manual pipettes have the disadvantage to have only a slight stroke of the actuation button at small dosing volumina, which results in a poor precision or a poor control, respectively, in the delivery of the liquid. Manual and electronic pipettes have the disadvantage that the effort to overcome the frictions of the sealings between piston and cylinder requires an increased expenditure of energy. Further, the pistons, cylinders and sealings disposed there between have to be maintained or greased, respectively. Generally, the setting range of piston pipettes is small. In order to cover greater ranges, several piston pipettes with different piston cross sections have to be provided.

Departing from this, the present invention has the objective to provide a pipetting device which makes it possible to work with the same actuation stroke at all dosing volumes that are set. Further, the pipetting device should have an enlarged setting range of the dosing volumina. In addition, the gas displacement equipment should have less expenditure for maintenance.

BRIEF SUMMARY OF THE INVENTION

The pipetting equipment according to the invention has a displacement chamber, a flexible membrane, delimiting the displacement chamber an aperture equipment, covering the edge region of the membrane, with at least one adjustable aperture opening, straight through which the central region of the membrane is deformable, a driving equipment for deforming the membrane, a coupling equipment between the driving equipment and the membrane for coupling the driving equipment with the membrane, an equipment for detachably holding a pipette point, and a connection channel between the displacement chamber and the equipment for detachably holding the pipette point.

In the pipetting device, the gas displacement is achieved by deformation of the membrane, which changes the volume of the displacement chamber. The dosing volume depends on the degree of deformation of the membrane. The deformation of the membrane is delimited to the central region of the membrane, which is disposed above the aperture opening, by means of the aperture equipment. Through this, the deformability of the membrane and the dosing volume is defined by the setting of the aperture opening. In the case that a small aperture opening is set, the deformable central region of the membrane is small and only a small volume of liquid can be dosed. With a large aperture opening, the deformable central region of the membrane is large and a correspondingly great volume of liquid can be dosed. The excursion of the membrane can be kept constant, i.e. independent of the aperture opening that is set. Accordingly, an adjustable, manual pipetting device with constant actuation stroke can be provided. The expenditure of energy for the actuation is decreased because the friction between piston or cylinder, respectively, and sealing is not applicable. A large range of adjustable dosing volumina can be covered by a small number of models. The setting range is increased with respect to conventional piston pipettes. Further, greasing of the sealings between piston and cylinder can be omitted.

The membrane can be realised in different ways. For instance, it may have a polygonal surface area. According to one embodiment, it has a circular surface area. The circular surface area is favourable with respect to the construction of the aperture equipment and a uniform deformation of the central region of the membrane.

The displacement chamber has a circular surface shaped opening for the aforementioned reasons, which is closed by the membrane. According to a further embodiment, the circular surface shaped opening is present on a completely or partially cylindrical and/or conical displacement chamber.

The membrane is a plane-shaped membrane, e.g. Preferably, the membrane is completely or partly dome shaped, so that it has particularly great deformability and the pipetting device has a correspondingly large setting range of dosing volumina.

An aperture equipment which covers the edge region of the membrane on one side only is enclosed in the invention. For instance, an aperture equipment which covers the edge region of the membrane on that side which does not face the displacement chamber is suited to ensure aspiration of an accurately defined amount of liquid into the pipette point. The ejection of this amount of liquid may take place with an overstroke, so that an aperture equipment delimiting the membrane deformation into the interior of the displacement chamber may be non-essential. According to a preferred embodiment, the aperture equipment covers the edge region of the membrane on both sides, so that the deformation of the membrane upon aspiration and ejection is defined. In order to ensure blowing out the picked-up amount of liquid as completely as possible, the aperture equipment may have a somewhat greater aperture opening on the side facing the displacement chamber than on the side opposed to the displacement chamber.

According to one embodiment, the aperture equipment comprises at least one iris diaphragm. Iris diaphragms are known as aperture diaphragms of photographic lenses. They consist of single blades, delimiting the aperture opening, with one turning spigot and one guide spigot each. While the turning spigots lay in bearings which are fixedly disposed on an annular disc shaped support, the guide spigots, which are guided by guiding slits of a turnable, annular disc shaped controlling member, which is adjustable by means of a cam-like actuation organ that projects towards the outside, create the opening or closing movements, respectively, of the blades. Through the form of the guiding slits and the blades it can be achieved that an iris diaphragm has a linear or a non-linear setting characteristics. According to one embodiment, the aperture equipment has one iris diaphragm on each one of both sides of the edge region of the membrane.

According to one embodiment, the aperture equipment is coupled to a setting equipment. The setting equipment is the cam-like actuation organ of an iris diaphragm or a little turning wheel, for instance. An electromechanical setting equipment is possible with electric pipettes in particular.

The coupling equipment is a fluid, for instance, which acts upon the side of the membrane opposite to the displacement chamber and which is movable by means of a piston, which is shiftable by means of the driving equipment. According to one embodiment, the coupling equipment is a coupling rod, connected to the driving equipment and the membrane. The coupling rod is shiftable by means of the driving equipment. Accordingly, the membrane is deformed. According to one embodiment, the coupling rod is connected to the centre of the membrane. Through this, uniform deformation of the membrane is supported.

In principle it is possible to set the dosing volume by setting the aperture equipment and the excursion of the membrane. Thus, by setting the excursion of the membrane, different dosing ranges may be selectable, for instance. According to one embodiment, the membrane is movable by the driving equipment about a constant excursion at all settings of the aperture equipment. This facilitates the operation with manual pipetting devices.

According to a further embodiment, the driving equipment is a manually drivable, mechanical driving equipment. According to another embodiment, the driving equipment has an electric motor for driving the coupling equipment. With this it is dealt with an electric pipette.

According to one embodiment, the aperture equipment and/or the driving equipment is coupled to a display equipment for the dosing volume.

In the case that the setting of the dosing volume takes place by setting the aperture equipment only, the display equipment is only coupled to the aperture equipment. The coupling may be of a mechanical nature. It may also be of an electronic nature, when the respective setting of the aperture equipment is scanned electronically or is determined by means of switching pulses of an electromechanical setting equipment and used for controlling the display equipment, for instance.

According to one embodiment, there is an electric control equipment, which is coupled to the driving equipment and/or the display equipment. The electric control equipment controls the movement of the driving equipment, so that the membrane is deflected about a desired amount. Additionally or instead, it controls the display of the respective displayed dosing volume by the display equipment.

In the case that the change of the volume of the displacement chamber does not linearly depend on the setting of the aperture equipment and/or the excursion of the membrane, this may be compensated for by a non-linear scale of the display equipment and/or a suitable gear between aperture equipment and/or driving equipment and display equipment. It is also possible to construct an aperture equipment with at least one iris diaphragm such that a linear correlation between the setting of the aperture equipment and the change of the volume of the displacement chamber is generated by the guide slits which are integrated into the iris diaphragm. Finally, it is possible to compensate for the nonlinearity in an electronic way, when the display equipment is connected to an electric control equipment.

According to one embodiment, the pipetting device has a grip-like, handleable housing.

According to one embodiment, the equipment for detachably holding the pipette point has a neck for putting on a pin-up opening of the pipette point. The neck is preferably a cone tapered towards its end, onto which a pipette point can be put in a clamping manner.

The invention will be hereinafter explained in more detail by means of the attached drawing of one example of realisation.

BRIEF DESCRIPTION OF THE SEVERA VIEWS OF THE DRAWINGS

FIG. 1 a pipetting device with large aperture opening before ejecting fluid, in a coarse, schematic longitudinal section.

Figure 2:
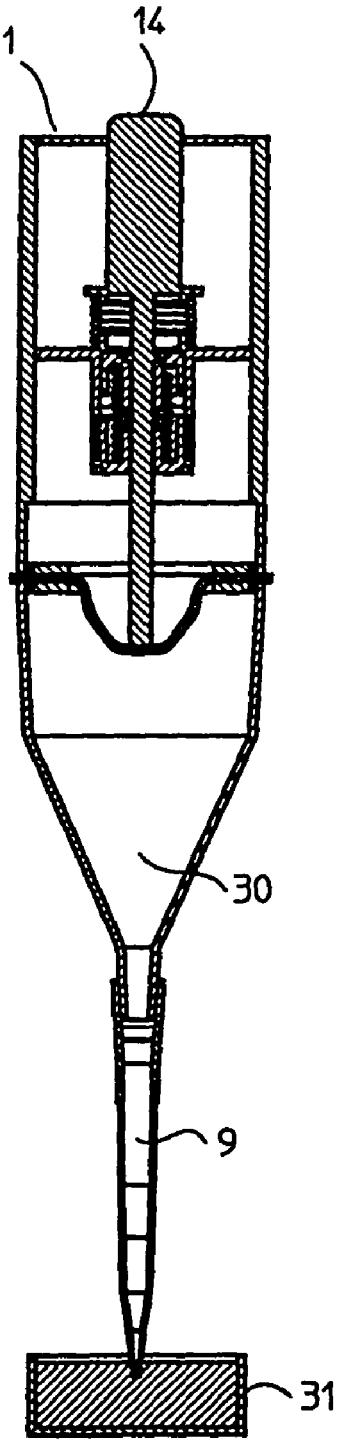

FIG. 2 the same pipetting device with large aperture opening after ejecting fluid, in a coarse, schematic longitudinal section.

Figure 3:
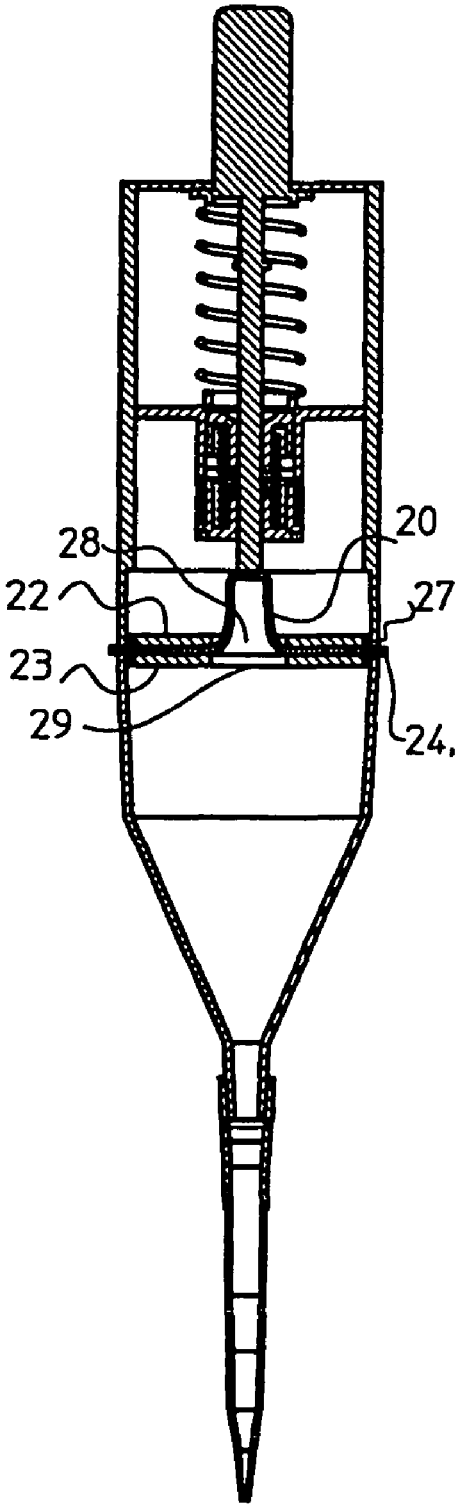

FIG. 3 the same pipetting device with small aperture opening before ejecting fluid, in a coarse, schematic longitudinal section.

Figure 4:
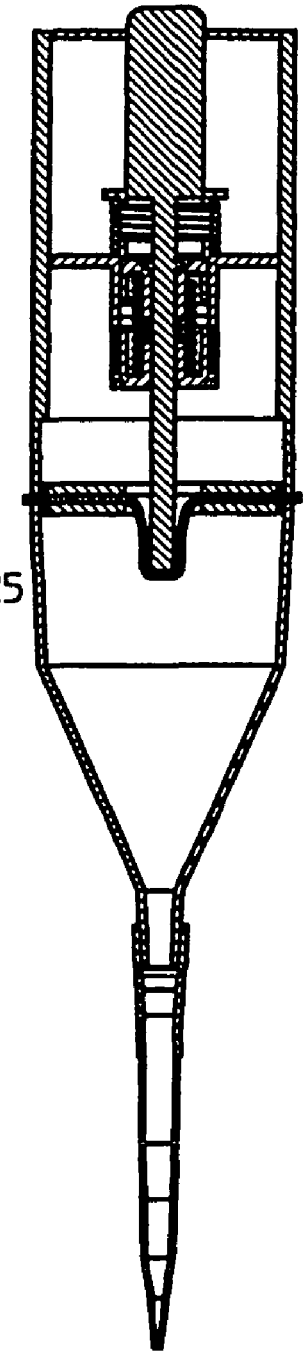

FIG. 4 the same pipetting device with small aperture opening after ejecting fluid, in a coarse, schematic longitudinal section.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated In the following description, the indications "top" and "bottom" or "upper" and "lower" are related to the usual orientation of the pipetting device when pipetting, in which the pipette point is held towards the bottom side with its lower opening for picking up and delivering liquids.

The pipetting device 1 has a grip-like housing 2. The housing 2 comprises substantially a hollow cylindrical portion 3, which has a cover 4 on its upper end. A hollow conical portion 5, tapered towards the bottom side, is adjacent to the hollow cylindrical portion 3. The lower end of the hollow conical portion 5 is followed by a hollow conical neck 6, which has only a small conicality. The neck 6 has a connection channel 7, which connects the cavity of the portion 5 with an opening 8 on the lower end of the neck 6.

A pipette point 9, made of plastic material, can be put on the neck 6 with an upper opening 10. On its bottom, the pipette point 9 has an opening 11 for the passage of liquids. The openings 10, 11 are connected to each other by a connection channel 12, which serves for picking up liquid.

A mechanical drive 13 is disposed in the upper region of the hollow cylindrical portion 3. The drive 13 has an actuation button 14, which projects from the cover 4 on the upside. On the bottom side, the actuation button 14 is connected to a coupling rod 15. Further, it has a limit stop 16, on which a spring 17 supports itself, which is supported on the other end by an abutment 18 in the housing 2. The abutment 18 has a counter-limit stop 19, with which the limit stop 16 co-operates.

The spring 17 pushes the limit stop 16 against the bottom side of the cover 4, which forms a further counter-limit stop.

Below the drive 13, a dome-shaped flexible membrane 20 with circular surface area is disposed in the hollow cylindrical portion 3 of the housing 2. The membrane 20 is sealingly fixed on the inner wall of the housing 2 on its perimeter.

The membrane 20 is made of a flexible plastic material (from polyethylene, polypropylene e.g.), silicone, rubber, Teflon or another fluorocarbon.

The edge portion of the membrane 20 is covered by an aperture equipment 21 on both sides. The aperture equipment 21 comprises two iris diaphragms 22, 23, the support of which is fixed on the perimeter of the housing 2. Two cam-like actuation organs 24, 25, which are connected to the adjustable setting equipment of the iris diaphragms 22, 23 are guided out of the housing through a slit 26 on the perimeter. The cam-like actuation organs 24, 25 are connected with each other. On the perimeter of the housing 2, a display equipment 27 in the form of a scale is assigned to the actuation organs 24, 25.

The magnitudes of the aperture openings 28, 29 of the two iris diaphragms 22, 23 are adjustable by swivelling the actuation organs 24, 25.

A displacement chamber 30 is formed below the membrane 20 in the hollow cylindrical portion 3, in the hollow conical portion 5 and in the neck 6.

The pipetting device is operated in the following way:

At first, a pipette point 9 is put on the neck 6. Further, a desired dosing volume is set by swivelling the actuation organs 24, 25 until they point towards a desired dosing volume on the scale 27. In FIG. 1, this state is shown for a large dosing volume set.

Thereafter, the actuation button 14 is pressed until the limit stop 16 sits closely on the counter-limit stop 19. In doing so, the dome-shaped membrane 20 is deformed towards the bottom side straight through the aperture openings 28, 29. Through this, the volume of the displacement chamber 30 is diminished.

Thereafter, the user releases the actuation button 14, so that the same is pressed back into the starting position by the action of the spring 17 until the limit stop 16 sits closely on the bottom side of the cover 4.

Through this, the volume of the displacement chamber 30 is increased by an amount which is defined by the setting of the aperture equipment 21. Accordingly, a desired amount of liquid is aspirated into the pipette point 9 from a reservoir 31.

In order to deliver the aspirated amount of liquid, the pipette 1 is directed towards a further reservoir with the appending pipette point 9, and the actuation button 14 is pressed again. By doing so, the volume of the displacement chamber 30 is diminished again about the defined amount, so that the gas column contained therein pushes the liquid out of the pipette point 9 into the reservoir.

After releasing the actuation button 14, the starting condition of FIG. 1 is reached. As the case may be, the pipette point 9 is replaced by a fresh pipette point 9 and the pipetting device is ready for a further dosing operation.

FIGS. 3 and 4 show the same pipetting device 1 with a different setting of the dosing volume. In this setting, the aperture openings 28, 29 are strongly diminished, so that deformation of the membrane 20 results in an only relatively small change of the volume of the displacement chamber 30. The dosing amount corresponding to the volume change can be read on the scale 27.

In order to realize an overstroke for ejecting small remaining amounts of the liquid, the iris diaphragms 22, 23 may be adjusted such that the magnitude of the aperture opening 29 exceeds somewhat the magnitude of the aperture opening 28 at each setting.

The excursion or the stroke, respectively, of the membrane 20 is the same at every dosing volume which is set. The energy required for actuation is also constant at each volume setting. This facilitates operation and serves to avoid dosing errors.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim 1f such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A pipetting device, comprising:

a displacement chamber (30);

a flexible membrane (20) delimiting the displacement chamber (30);

a driving equipment (13) for deforming the membrane (20);

a coupling equipment (15) between the driving equipment (13) and the membrane for coupling the driving equipment (13) with the membrane (20);

an equipment (6) for detachably holding a pipette tip, and a connection channel (7) between the displacement chamber (30) and the equipment (6) for detachably holding the pipette tip;

further characterized in an aperture equipment (21), for adjusting the size of at least one aperture opening (28, 29), the aperture equipment (21) covering the edge region of the membrane (20) with the at least one adjustable aperture opening (28, 29) straight through which the central region of the membrane (10) is deformable.

2. The pipetting device of claim 1, in which the membrane (20) has a circular surface area.

3. The pipetting device of claim 1, in which the membrane (20) is completely or partly dome shaped.

4. The pipetting device of claim 1, in which the membrane (20) closes a circular surface shaped opening of a displacement chamber (30).

5. The pipetting device of claim 4, in which the membrane (20) closes an opening of a completely or partially cylindrical and/or conical displacement chamber (30).

6. The pipetting device of claim 1, in which the aperture equipment (21) covers the edge region of the membrane (20) on both sides.

7. The pipetting device of claim 1, in which the aperture equipment (21) comprises at least one iris diaphragm (22, 23).

8. The pipetting device of claim 7, in which the aperture equipment (21) has each one iris diaphragm (22, 23) on both sides of the edge region of the membrane (20), respectively.

9. The pipetting device of claim 1, in which the aperture equipment (21) is coupled to a setting equipment (24, 25).

10. The pipetting device of claim 1, in which the coupling equipment (15) is a coupling rod, which is connected to the driving equipment (13) and the membrane (20).

11. The pipetting device of claim 10, in which the coupling rod (15) is connected to the centre of the membrane (20).

12. The pipetting device of claim 1, in which the membrane (20) is movable by the driving equipment (13) about a constant path at all settings of the aperture equipment (21).

13. The pipetting device of claim 1, in which the driving equipment (13) is a manually drivable, mechanical driving equipment.

14. The pipetting device of claim 1, in which the driving equipment (13) has an electric motor for driving the coupling equipment.

15. The pipetting device of claim 1, in which the aperture equipment (21) and/or the driving equipment (13) is coupled to a display equipment (27) for the dosing volume.

16. The pipetting device of claim 1, which has an electric control equipment which is coupled to the driving equipment (13) and/or the display equipment (27).

17. The pipetting device of claim 1, which has a grip-like, handleable housing (2).

18. The pipetting device of claim 1, in which the equipment (6) for detachably holding the pipette tip (9) has a neck for putting on a pin-up opening (10) of the pipette tip (9).

19. A pipetting device, comprising:

a displacement chamber (30);

a flexible membrane (20) delimiting the displacement chamber (30);

a driving equipment (13) for deforming the membrane (20);

a coupling equipment (15) between the driving equipment (13) and the membrane for coupling the driving equipment (13) with the membrane (20);

an equipment (6) for detachably holding a pipette tip;

a connection channel (7) between the displacement chamber (30) and the equipment (6) for detachably holding the pipette tip, and a device connected to the pipetting device, for adjusting the size of the aperture openings (28, 29), through which the central region of the membrane (10) is deformable, the adjustment of the aperture opening changing the volume of the membrane extending through the aperture openings.

* * * * *